United States Patent [19]

Romagnoli

[11] Patent Number: 5,031,825

[45] Date of Patent: Jul. 16, 1991

[54] PACKAGING BOX AND BLANK FOR OBTAINING THEREOF

[75] Inventor: Andrea Romagnoli, Bologna, Italy

[73] Assignee: Cestind S.R.L., Bologna, Italy

[21] Appl. No.: 470,648

[22] Filed: Jan. 24, 1990

[51] Int. Cl.[5] ..... B65D 5/02

[52] U.S. Cl. ..... 229/160.1; 206/624

[58] Field of Search ..... 206/621, 624, 268, 271, 206/273; 229/160.1

[56] References Cited

U.S. PATENT DOCUMENTS

| | | | |
|---|---|---|---|
| 2,881,967 | 4/1959 | Ringler | 206/624 |
| 2,951,627 | 9/1960 | Wenzel | 206/624 |
| 3,207,416 | 9/1965 | Koltz et al. | 206/624 |
| 3,347,446 | 10/1967 | Guyer et al. | 206/624 |
| 4,726,471 | 2/1988 | Whately et al. | 206/624 |
| 4,913,292 | 4/1990 | Field | 206/624 |

FOREIGN PATENT DOCUMENTS

| | | | |
|---|---|---|---|
| 679478 | 2/1964 | Canada | 206/624 |

*Primary Examiner*—Gary E. Elkins

*Attorney, Agent, or Firm*—Darby & Darby

[57] ABSTRACT

A blank for producing a box with an opening has longitudinal and transverse folding lines to provide a box with a hinged lid. An upper breakable line in the blank allows a strip to be detached and glued to the blank while erecting the box in order to form a flange fixed to an inner border of the box opening. A lower breakable line in the blank keeps the hinged lid closed with a guarantee seal closure.

4 Claims, 3 Drawing Sheets

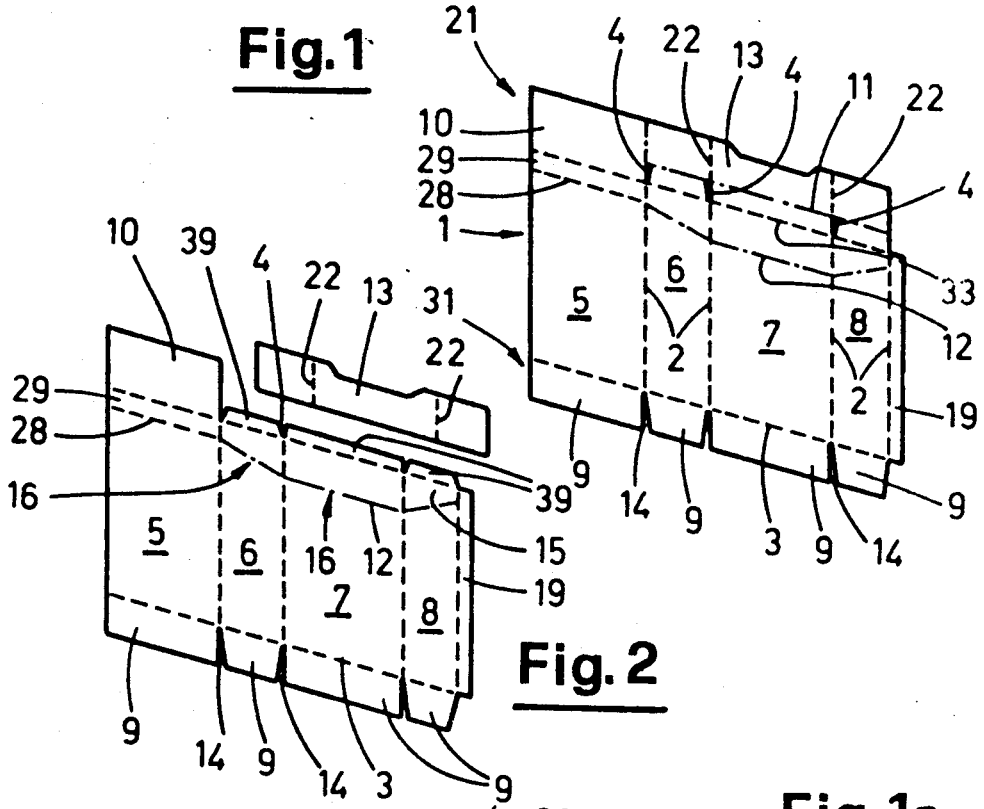
Fig. 1
Fig. 2
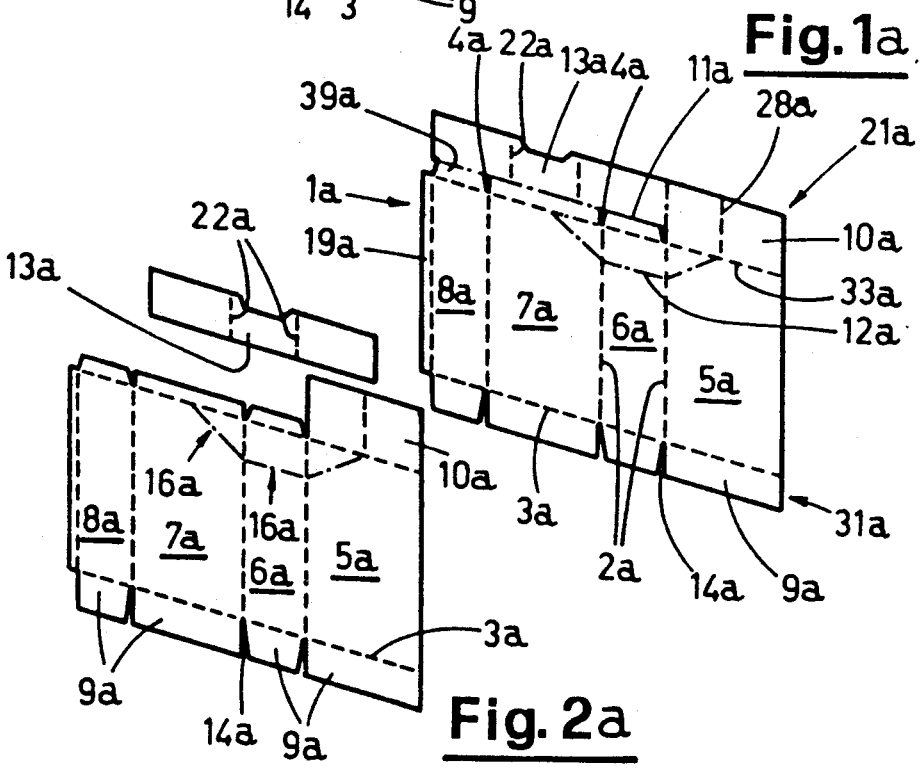
Fig. 1a
Fig. 2a 10
5
4
19
8
6
4
13
9

10
5
8
9
14
9

10
39
7
9

12
8
7

29
8
13
7

PACKAGING BOX AND BLANK FOR OBTAINING THEREOF

BACKGROUND OF THE INVENTION

The invention relates to a packaging box obtained through a related method and to the blank for obtaining this box.

DESCRIPTION OF THE PRIOR ART

The Applicant already owns a Patent granted on the basis of a corresponding U.S. Ser. No. 210,716 filed on June 23rd, 1988, in which a method for the production of packaging boxes is claimed.

In the field of the packaging or wrapping of foodstuffs, household products such as detergent powders, pharmaceuticals and the like it is known to use prefabricated cases or boxes in a flat folded tubular shape which are supplied to the packaging machines for these products by taking them up in individual sequence from a store, usually of the hopper type, in which they are stacked, carrying out, during the stage in which they are individually supplied, the operation to erect them into their tubular shape so that the product to be packaged can be supplied thereto and thereafter the operation to close their opposite ends or heads.

At present the process for obtaining these prefabricated boxes in this flat folded tubular shape substantially comprises a first stage for the preparation of sheets of board each comprising stamped therein in transverse and longitudinal rows or strips, a plurality of plane blanks joined together by connections which can be broken with notches defining the members for producing and closing the boxes and the separation of these sheets into individual plane blanks at the locations of these breakable connections for their palletization in superimposed layers with interposed plane support elements in tranversally and longitudinally adjacent multiple stacks, and a second stage for the manual supply of these individual stacks of successive layers to a supply hopper from which these blanks are taken up and supplied in individual sequence for the operations for folding and glueing in the flat folded tubular shape and are usually packaged in this shape in boxed stacks or packs so that they can be supplied to consumers for the packaging therein of foodstuffs, household products such as detergent powders, pharmaceuticals and the like.

The machines for carrying out the above process to obtain these prefabricated boxes in their flat folded tubolar shape are relatively complex and extremely costly with the result that advances in technology in the specific sector of packaging have led to testing of other methods to solve the problem of supplying these plane stamped members or blanks and their production as packaging boxes.

The packages obtained through the methods which the introductory statement refers to, usually consist of a box or case of the so called "flanged" type with a hinged lid, e.g. for packaging cigarettes.

Such type of boxes are substantially obtained through a series of folding of a blank followed by fixing a folded strip.

The strip constitutes a flange against which the inner border of the hinged lid rests.

This strip, or flange, is formed by a central panel and two lateral portions folded along two transverse folding lines.

The flange is attached to the inner facing of the front panel of the box and to the inner facings of the lateral sides of the box, projecting with the upper edge over the upper border of the box opening.

Usually the strip is fed to the machine for making these boxes, from a coil of cardboard web, the web being cut at a preset length and then folded and sent to the line where the box is erecting.

Such a kind of boxes are described in the U.S. Pat. Nos. 3,972,271 and 3,967,543.

All boxes obtained through this method do not provide a sealed closure for guaranteeing the product(s) contained therein, and such kind of closure must be obtained by other way with a further operation, e.g. by wrapping the box with a heat shrinkable film, or with a tubular film and then glueing the heads of the tube.

It was the the object of the invention disclosed in the U.S Ser. No. 210,716 to provide a method for the production of packaging boxes by supplying plane stamped members of blanks in individual sequence, starting from pallets of sheets with a plurality of stamped elements.

The method therein described permits the producing a packaging box with a sealed closure guaranteeing the product(s) contained therein.

Particularly the method dislosed in the U.S. Ser. No. 210,716 is designed to produce boxes for the packaging of foodstuffs, household products such as detergent powders, pharmaceuticals and like, starting from pallets of sheets of board each comprising stamped therein a plurality of plane blanks joined together in adjacent transverse and longitudinal strips by connections which can be broken and are provided with notches, fold lines and break lines defining the members for producing and closing these boxes, which method is characterized in that it comprises a sequence of steps including the sequential take up from the pallet of these sheets with multiple adjacent strips of plane stamped elements or blanks, the sequential separation at the location of the respective break members of these strips of multiple plane stamped members or blanks from the sheet of multiple strips taken from the pallet, the sequential separation, also at the location of the respective break members, of these plane stamped members or blanks from these strips of multiple stamped members or blanks, the supply in individual sequence of these plane stamped members or blanks separated from the strips with multiple blanks, the detachment of a portion from these individual plane stamped members or blanks supplied in sequence at the respective break line and the application of this portion to the respective individual plane stamped members designed to form the relative flange of the corresponding box, the folding about the respective fold lines of these plane stamped members and the associated glueing of the respective member for the production of the latter in their tubular shape to contain the product(s) to be packaged and the folding of the members for producing and closing the opposite ends or heads by glueing providing boxes of the flanged type with a sealed closure guaranteeing the product(s) contained therein along the relative break line.

A particular feature offered by the method of the invention is that of being able to package the product(s) during the production of these boxes by folding the relative blanks around the corresponding products to be packaged, or by inserting these products through one end after the blanks have been produced in their tubular shape, even after the closure of one of these ends, or at any time after production is complete through one end which is obviously kept open.

It is an object of the present invention to provide the box of the so-called flanged type with a sealed closure guaranteeing the product(s) contained therein, such that it is not needed for its production to make use of a supply of other material, both for the formation of the flange and for the formation of the closure.

A further object of the invention is to allow the obtaining of such packaging box by providing a blank particularly shaped and cut in order to build this kind of box.

A further object of the invention is to allow the implementation of the method described in the U.S. Ser. No. 210,716 by providing both the blank and the box obtained therefrom, in accordance with the preceding objects, and with the claims hereinafter written.

These and other objects are achieved with the packaging box that is provided with a hinged lid connected to the body of the box and with a flange attached to the inner facings of the frontal panel and lateral sides in such a way that it protrudes upwardly over the upper border of the box opening, with the lid having one edge hinged to the body of the box and the other edge resting against the flange and attached to the upper border of the box opening by means of straps obtained along a broken line made in the upper part of the box front panel and delimiting the border of the box opening and the lower edge of the lid.

The present invention also provides a blank for producing the afore mentioned box, this blank comprising longitudinal folding lines and transversal folding lines so as to define a plurality of areas designd to constitute, when the blank is folded, the front panel, the back panel, the bottom, the lateral sides, and the lid of a packaging box, with said lid hinged to a section of the border of the box opening, sad blank further comprising two break lines, namely an upper break line and a lower break line, said upper break line allowing a strip to be detached from said blank and glued to the same in order to form a flange fixed to the inner border of the box opening, and the lower break line being designed to delimit the box opening border and the lid lower edge leaving a plurality of straps attaching said opening border to said lid lower edge.

While further characteristic features and advantages will be described in detail in the following description, that concludes with claims which particularly point out and distinctly claim the subject matter forming the present invention, it is believed that the invention will be better understood from the whole specification, taken in conjuntion with the accompanying drawings in which:

FIG. 1 shows a perspective view of the blank herein described and claimed;

FIGS. 2,3,4,5,6 show in perspective views the series of stages through which the packaging box is made up from the blank;

FIG. 7 shows in perspective view the packaging box obtained from the blank of FIG. 1, with the guaranteeing closure seal broken and the hinged lid open;

FIGS. 1A to 7A show views similar to FIGS. 1 to 7, for the production of a box made up in accordance with a second embodiment of the present invention.

DESCRIPTION OF THE PREFERRED EMBODIMENT

Figures 3, 4, 5, 6, 7:
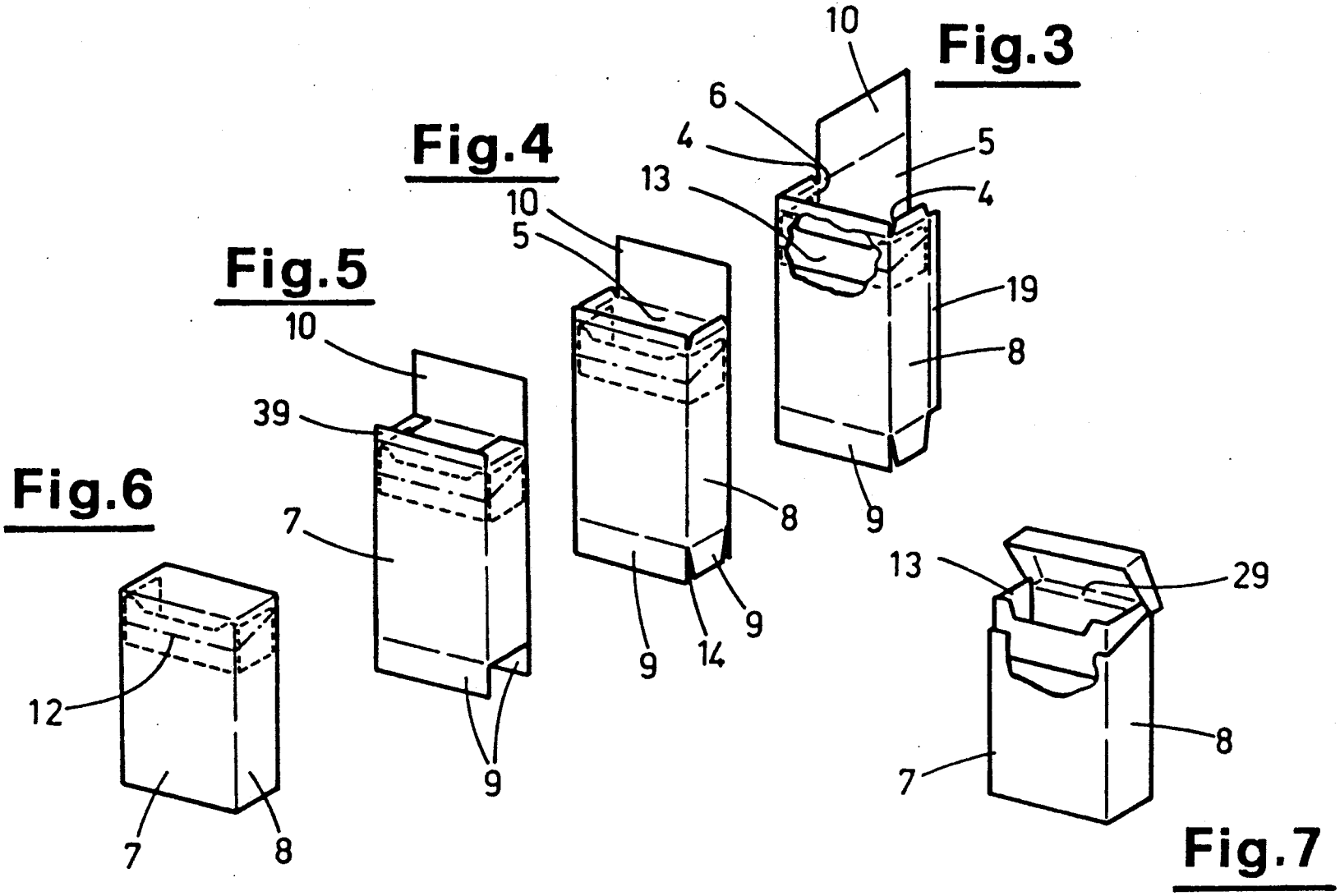
Figure 3A:
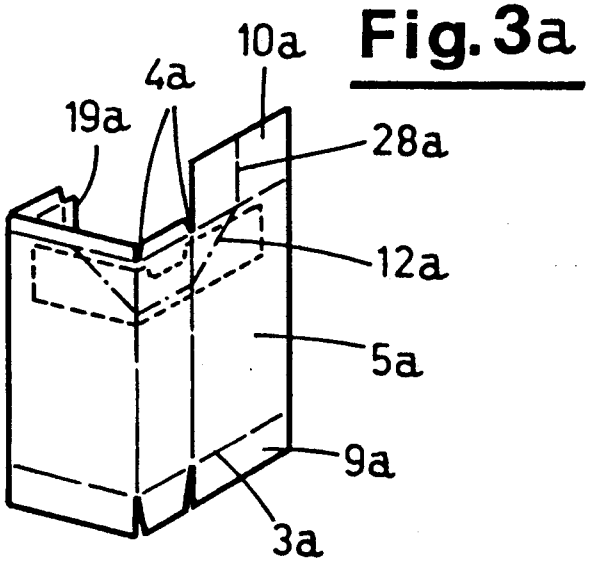

As already mentioned above, the aim of the invention is to provide a packaging box of the so called flanged type, having a hinged lid and a guarantee seal closure.

The box require simple folding of the blank such that it can be made up through the method described in the U.S. Ser. No. 210,716 and thus by means of a machine that is simpler and cheaper in respect of the machine used so far.

In the blank, as shown in FIG. 1 with reference 1, there are longitudinal folding lines 2 and transversal folding lines, upper folding line 33 and lower folding line 3 respectively.

The longitudinal folding line 2 and the transversal folding lines 3,33 define a series of contiguous areas 5,6,7 and 8 each one foldable in respect of the adjacent one over a folding line 2.

Furthermore the lower transverse folding line 3 and the upper transverse folding line 33, define a lower section 31 and an upper section 21 respectively, in the blank, adjoned to the series of areas on both upper and lower heads, and foldable along the folding lines 3,33.

A number of longitudinal slits 14 are made in the lower section 31, so that the lower flaps 9 can be individually folded, as being detached from the contiguous ones.

One of the external areas, the one indicated by 8 for example, has a longitudinal flap 19, that is delimited by a longitudinal folding line 2 and that is designed to be glued to the area 5, while erecting the packaging box, in order to form the tubular body of the box.

The area 5, that is designed to form the back panel of the box, has an intermediate transversal folding line 28, made near to the upper edge thereof, i.e. near to the upper folding line 33, so as to leave a stripe 29, the task of which will be explained in the following.

Starting from the end of the line 28, there is a lower breakable line 12 that is inclined in the area 6 so as to deviate away from the upper line 33.

Then the breakable line 12 goes on parallel to the upper line 33 in the area 7, and lastly again inclined in the area 8, so as to go closer to the line 33, up to the same distance as the folding line 28.

This breakable line 12 leaves a number of straps 16 which keep the portion 15, thus defined by the line 12, together with the areas 6,7 and 8.

The upper part of the blank delimited by the upper folding line 33, has an upper transversal breakable line 11, over the areas 6,7 and 8, that turns upword in correspondence with the longitudinal folding line 2 that separates these areas from the left end area 5.

This upper breakable line 11 delimits a strip 13 that can be detached from the blank and folded along longitudinal short folding lines 22, made therein, in order to form the flange.

The stripe comprised between the strip 13 and the areas 6,7 and 8 (i.e. the upper folding line 33), has two longitudinal cuts 4, in correspondence with the longitudinal folding lines 2 which separate the area 7, designed to form the front panel of the box, in respect of the areas 6 and 8.

These cuts 4 allow the upper flaps 39 to be individually folded as being detached one in respect of the others.

The longitudinal part of the breakable line 11, together with a cut 4 delimit a flap 10, attached to the stripe 29 and designed to form the upper part of the hinged lid.

As it is shown in FIGS. 2,3,4,5 and 6, the box is erected through following folding stages, according to the method claimed in the U.S. Ser. No. 210,716.

First the strip 13 is detached from the blank along the upper breakable line 11 and then glued to the blank in correspondence with the lower breakable line 12. The glue is applied to the blank beneath this breakable line 12.

The blank is then folded over the longitudinal folding lines 2 and the flap 19 is glued to the corresponding inner surface of the area 5.

The tubular shape is thus achieved for the packaging box.

In a subsequent stage the lower flaps 9 are folded over the fold line 3 and glued to form the bottom of the box.

In the same stage the upper flaps 39 are folded over the upper folding line 33 as well as the flaps 10, that is then glued to the previously folded flaps 39 in order to form the lid of the box.

As it results in FIG. 6, the lid is kept closed by the straps 16 left along the lower break line 12, thus forming a guarantee closure seal for the box.

In fact, to open the box as shown in FIG. 7, it is necessary to break the straps 16, and this way the box having been opened is made evident.

In FIG. 7 it also appears the strip 13 forming the flange for the so called flanged type box.

The lid is hinged along the intermediate folding line 28.

Figure 7A:
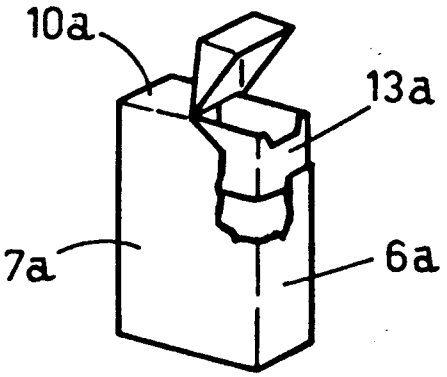
Figure 4A:
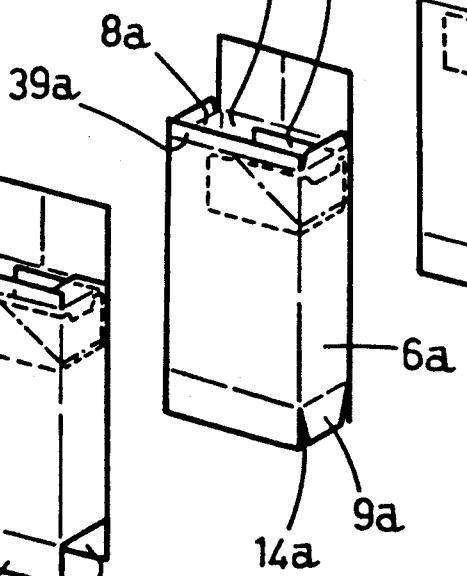
Figure 5A:
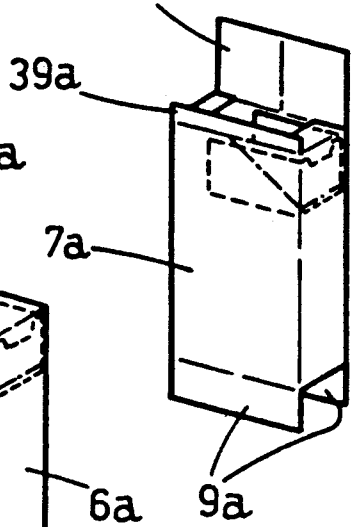

The further embodiment of the present invention shown in FIGS. 1A to 7A, differs from the described above with reference to FIGS. 1 to 7, which has a lid hinged about the fold line 28 that is opposite, when the box is packaged, to the break line 12 of the guarantee seal, since in this case the flange closure is provided at one corner of the box with the relative lid hinged about a folding line **28*a*** transversely made in the upper head of the box.

The guarantee closure seal is obtained by a breakable line having two inclined sections made in the front panel **7*a* and in the back panel 5*a*, and starting from the upper head of the box, in corrispondence with said folding line 28*a***.

The breakable line 12 then has a straight section that connects the two end extremities of the inclined sections.

Accordingly the blank **1*a* particularly differs from the previously described blank 1** in its upper part.

The parts of the blank **1*a*** and box in this second embodiment are indicated by the same reference numerals as in the previous embodiment with addition of "a".

As it is shown in FIG. 1A the blank **1*a* has longitudinal folding lines 2*a* and transverse folding lines 3*a*,33*a*, in order to delimit four areas 5*a*,6*a*,7*a*,8*a*, with a lower section 31*a* and an upper section 21*a***.

Lower flaps flaps **9*a* are made in the lower section 31*a* and divided by slits 14*a*** made therein.

The upper part of the blank has a lower breakable line **12*a* that starts from the upper folding line 33*a* in the middle of the area 5*a*, in corrispondence with the folding line 28*a* made in the flap 10*a*, and is inclined so as to go away from the upper folding line 33*a***.

Between the two longitudinal folding lines **2*a* delimiting the area 6*a*, there is a straight section of the breakable line 12*a* and then again an inclined section of this breakable line in the area 5*a*, so that the line 12*a* goes closer to the upper fold line 33*a* up to reach it in the point that corresponds to the starting point in area 7*a***.

In the upper section **21*a* there are an upper breakable line 11*a*, that delimits the strip 13*a* and a flap 10*a***.

Upper flaps **39*a* are made between the upper folding line 33*a* and the upper breakable line 11*a*, and divided by means of slits 4*a***.

The strip **13*a* has the central section delimited by two small longitudinal folding lines 22*a*** and shorter than the lateral sections, since the central section has to be attached to a side panel of the box, instead of the front panel.

FIGS. 2A to 6A show the following stages to erect the box.

First the strip **13*a* is detached from the blank along the upper breakable line 11*a* and then it is glued to the blank in correspondence with the lower breakable line 12*a*. The glue is applied to the blank beneath this breakable line 12*a***.

The blank is then folded over the longitudinal folding lines **2*a* and the flap 19*a* is glued to the corresponding inner surface of the area 5*a***.

The tubular shape is thus achieved for the packaging box.

In a subsequent stage the lower flaps **9*a* are folded over the fold line 3*a*** and glued to form the bottom of the box.

In the same stage the upper flaps **39*a* are folded over the upper folding line 33*a* as well as the flap 10*a*, that is then glued to the previously folded flaps 39*a*** in order to form the lid of the box.

Figure 6A:
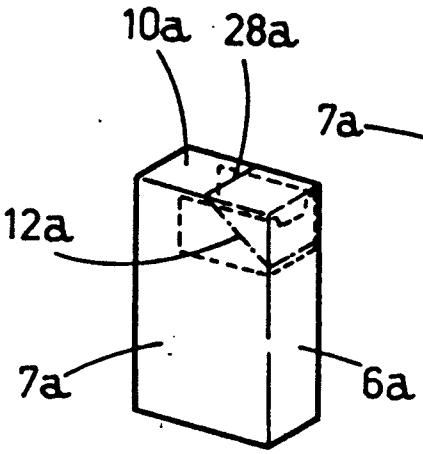

As it results in FIGS. 6A, the lid is kept closed by the straps **16*a* left along the lower break line 12*a***, thus forming a guarantee closure seal for the box.

In fact, to open the box as shown in FIG. 7A, it is necessary to break the straps **16*a***, and this way the box having been opened is made evident.

In FIG. 7A it also appears the strip **13*a*** forming the flange for the so called flanged type box.

The lid is hinged along the folding line **28*a*** made in the upper head of the box.

The invention may be applied to cartons of any form or dimension.

To those skilled in the art to which this invention relates, many changes in the construction and widely differing embodiments and applications of the invention will suggest themselves without departing from the spirit and the scope of the invention.

The disclosures and the description herein are purely illustrative and are not intended to be in any sense limiting.

What is claimed is:

1. A blank for producing a flanged packaging box, said blank having longitudinal folding lines and transversal folding lines so as to define a plurality of areas designed to constitute, when said blank is folded, a front panel, a back panel, a bottom, lateral sides, and a lid of said packaging box, said transversal folding lines also defining in the blank a lower section and an upper section, with said lid hinged to a border of said back panel, said blank further comprising:

an upper breakable line made in said upper section and allowing a strip to be detachable from said blank in order to be glued to said box and to form a flange fixed to an inner border of said box opening;

a lower breakable line made straight in the area designed to constitute the front panel of the box being erected and made inclined in the two areas destined to constitute the lateral sides of said box, said lower breakable line being designed to delimit a border of said box opening and a lower edge of said lid leaving a plurality of straps which keep said opening border attached to said lid lower edge, thus defining a guarantee seal closure for said box.

2. A blank for producing a flanged packaging box, as claimed in claim 1, further comprising a small transverse folding line made in said area designed to constitute the back panel of said box, near to said upper section, and in correspondence with said lower breakable line, so as to constitute the hinge for said lid.

3. A blank for producing a flanged packaging box, said blank having longitudinal-folding lines and transversal folding lines so as to define a plurality of areas designed to form, when said blank is folded, a front panel, a back panel, two lateral sides, a bottom, and a lid for covering an opening of said packaging box, said transversal folding lines also defining in the blank a lower section and an upper section, said blank further comprising:

an upper breakable line made in said upper section and allowing a strip to be detachable from said blank in order to be glued to said box and to form a flange fixed to an inner border of said box opening;

a further small longitudinal folding line, made in said upper section and designed to form a hinge for said lid;

a lower breakable line that starts from said upper folding line in the middle of the area designed to form said front or back panel, in accordance with said further small longitudinal folding line, said lower breakable line being inclined away from said upper folding line, said lower breakable line being straight in one of said areas designed to constitute said lateral sides, and then again inclined in the remaining area designed to constitute the back or front panel respectively of said box, so as to reach said upper folding line;

said lower breakable line being designed to delimit a border or said box opening and a lower edge of said lid, and leaving a plurality of straps which keep said lid lower edge connected with said opening border, thus defining a guarantee seal closure for said box.

4. A packing box comprising:

a single layered tubular body that comprises a frontal panel, a back panel, two lateral sides, connected in series and folded along longitudinal folding lines;

a bottom formed by areas hinged to lower borders of said frontal and back panels and said lateral sides, said areas being folded and glued one to another;

a breakable line made straight in said front panel, inclined in said lateral sides, and being designed to form, after the box has been opened, a border of an opening of said box, said breakable line leaving a lid hinged to said back panel by means of a transverse folding line, said lid being connected, before said box is opened, to said border of said opening by means of straps obtained by said breakable line, thus obtaining a guarantee seal closure for said box;

a flange attached to inner facings of said frontal panel and lateral sides, said flange projecting upwardly over said border of said opening.

* * * * *